US008576065B2

(12) United States Patent
Buck et al.

(10) Patent No.: US 8,576,065 B2
(45) Date of Patent: Nov. 5, 2013

(54) SYSTEMS AND METHODS FOR VARIABLE COLLISION AVOIDANCE

(75) Inventors: James J. Buck, Longmont, CO (US); Joseph P. Newell, Louisville, CO (US)

(73) Assignee: BI Incorporated, Boulder, CO (US)

( * ) Notice: Subject to any disclaimer, the term of this patent is extended or adjusted under 35 U.S.C. 154(b) by 425 days.

(21) Appl. No.: 12/917,856

(22) Filed: Nov. 2, 2010

(65) Prior Publication Data

US 2011/0133928 A1 Jun. 9, 2011

Related U.S. Application Data

(60) Provisional application No. 61/266,206, filed on Dec. 3, 2009.

(51) Int. Cl.
*G08B 1/08* (2006.01)

(52) U.S. Cl.
USPC ..... 340/539.13; 340/539.26; 340/435; 340/436; 340/438; 340/441; 340/901; 340/903; 340/905; 340/8.1; 701/70; 701/93; 701/119

(58) Field of Classification Search
USPC ..... 340/539.13, 539.26, 435, 436, 348, 340/441, 901–905, 8.1; 701/70, 93, 117, 701/119
See application file for complete search history.

(56) References Cited

U.S. PATENT DOCUMENTS

| | | | |
|---|---|---|---|
| 4,475,481 | A | 10/1984 | Carroll |
| 4,549,264 | A | 10/1985 | Carroll |
| 4,658,357 | A | 4/1987 | Carroll |
| 4,724,427 | A | 2/1988 | Carroll |
| 4,777,477 | A | 10/1988 | Watson |
| 4,821,823 | A | 4/1989 | Skibinski |
| 4,843,377 | A | 6/1989 | Fuller |
| 4,857,893 | A | 8/1989 | Carroll |
| 4,885,571 | A | 12/1989 | Pauley |
| 4,916,435 | A | 4/1990 | Fuller |
| 4,918,432 | A | 4/1990 | Pauley |
| 4,996,161 | A | 2/1991 | Conners |
| 4,999,613 | A | 3/1991 | Williamson |
| 5,043,736 | A | 8/1991 | Darnell et al. |
| 5,146,207 | A | 9/1992 | Henry |
| 5,220,919 | A | 6/1993 | Phillips et al. |

(Continued)

FOREIGN PATENT DOCUMENTS

| | | |
|---|---|---|
| WO | WO/98/08204 | 2/1998 |
| WO | WO/00/77688 | 12/2000 |

(Continued)

OTHER PUBLICATIONS

U.S. Appl. No. 12/041,746, filed Mar. 4, 2008, Buck, et al.

(Continued)

*Primary Examiner* — Tai T Nguyen
(74) *Attorney, Agent, or Firm* — Hamilton, DeSanctis & Cha

(57) ABSTRACT

Various embodiments of the present invention provide systems and method for collision avoidance. As an example, a system for collision avoidance is disclosed that includes: a first monitoring device, a second monitoring device, and a monitoring system. The monitoring system is operable to: receive information from the first monitoring device and the second monitoring device, identify a first zone around the first monitoring device and a second zone around the second monitoring device, and identify an intersection of the first zone and the second zone.

20 Claims, 9 Drawing Sheets

(56) References Cited

U.S. PATENT DOCUMENTS

| | | | | |
|---|---|---|---|---|
| 5,627,520 | A | 5/1997 | Grubbs et al. | |
| 5,731,757 | A | 3/1998 | Layson, Jr. | |
| 5,867,103 | A | 2/1999 | Taylor, Jr. | |
| 5,889,474 | A | 3/1999 | LaDue | |
| 5,923,300 | A | 7/1999 | Mejia | |
| 5,936,529 | A | 8/1999 | Reisman et al. | |
| 5,952,941 | A * | 9/1999 | Mardirossian | 340/936 |
| 5,959,533 | A | 9/1999 | Layson, Jr. | |
| 5,982,281 | A | 11/1999 | Layson, Jr. | |
| 6,014,080 | A | 1/2000 | Layson, Jr. | |
| 6,072,396 | A | 6/2000 | Gaukel | |
| 6,130,620 | A | 10/2000 | Pinnow et al. | |
| 6,160,481 | A | 12/2000 | Taylor | |
| 6,218,945 | B1 | 4/2001 | Taylor | |
| 6,512,456 | B1 | 1/2003 | Taylor | |
| 6,606,304 | B1 | 8/2003 | Grinter | |
| 6,674,368 | B2 | 1/2004 | Hawkins et al. | |
| 6,700,547 | B2 | 3/2004 | Mejia et al. | |
| 6,703,936 | B2 | 3/2004 | Hill et al. | |
| 6,774,797 | B2 | 8/2004 | Freathy | |
| 6,774,799 | B2 | 8/2004 | Defant | |
| RE38,838 | E | 10/2005 | Taylor | |
| 6,992,582 | B2 | 1/2006 | Hill et al. | |
| 7,038,590 | B2 | 5/2006 | Hoffman et al. | |
| 7,102,510 | B2 | 9/2006 | Boling | |
| 7,119,695 | B2 | 10/2006 | Defant | |
| 7,123,141 | B2 | 10/2006 | Contestabile | |
| 7,205,890 | B2 | 4/2007 | Defant | |
| RE39,909 | E | 11/2007 | Taylor | |
| 7,330,122 | B2 | 2/2008 | Derrick et al. | |
| 7,386,152 | B2 | 6/2008 | Rowe et al. | |
| 7,518,500 | B2 | 4/2009 | Aninye | |
| 7,545,318 | B2 | 6/2009 | Derrick | |
| 7,619,513 | B2 | 11/2009 | Hill et al. | |
| 7,701,171 | B2 | 4/2010 | Defant | |
| 7,737,841 | B2 | 6/2010 | Derrick | |
| 7,804,412 | B2 | 9/2010 | Derrick | |
| 7,859,392 | B2 * | 12/2010 | McClellan et al. | 340/441 |
| 7,930,927 | B2 | 4/2011 | Cooper et al. | |
| 7,936,262 | B2 | 5/2011 | Derrick | |
| 7,961,092 | B2 | 6/2011 | Freathy et al. | |
| RE42,671 | E | 9/2011 | Taylor | |
| 8,068,036 | B2 * | 11/2011 | Ghazarian | 340/903 |
| 2002/0140559 | A1 | 10/2002 | Zhou et al. | |
| 2003/0109988 | A1 | 6/2003 | Geissler et al. | |
| 2003/0210149 | A1 | 11/2003 | Reisman et al. | |
| 2004/0236199 | A1 | 11/2004 | Hawthorne et al. | |
| 2005/0250440 | A1 | 11/2005 | Zhou et al. | |
| 2006/0202836 | A1 | 9/2006 | Hawthorne et al. | |
| 2006/0202837 | A1 | 9/2006 | Hawthorne et al. | |
| 2008/0012760 | A1 | 1/2008 | Derrick et al. | |
| 2008/0108370 | A1 | 5/2008 | Aninye | |
| 2008/0316022 | A1 | 12/2008 | Buck et al. | |
| 2010/0007523 | A1 * | 1/2010 | Hatav | 340/901 |
| 2010/0123589 | A1 | 5/2010 | Buck et al. | |
| 2010/0240969 | A1 | 9/2010 | Rompa et al. | |
| 2011/0133937 | A1 | 6/2011 | Buck | |
| 2011/0154887 | A1 | 6/2011 | Cooper et al. | |

FOREIGN PATENT DOCUMENTS

| | | |
|---|---|---|
| WO | WO/2005/019977 | 3/2005 |
| WO | WO/2005/038590 | 4/2005 |
| WO | WO/2006/108077 | 10/2006 |
| WO | WO/2006/121930 | 11/2006 |
| WO | WO/2006/122004 | 11/2006 |
| WO | WO2007/027943 | 3/2007 |
| WO | WO/2007/037794 | 4/2007 |
| WO | WO/2008/008666 | 1/2008 |
| WO | WO/2008/008667 | 1/2008 |
| WO | WO/2008/008669 | 1/2008 |
| WO | WO/2008/008670 | 1/2008 |
| WO | WO/2008/027948 | 3/2008 |
| WO | WO/2008/027985 | 3/2008 |

OTHER PUBLICATIONS

U.S. Appl. No. 12/714,581, filed Mar. 1, 2010, Buck, et al.

Marques, et al., "Evaluating Transdermal Alcohol Measuring Devices" Pacific Institute for Research and Evaluation, NHTSA, Nov. 2007 pp. 1-96.

Pollard, et al. "Review of Technology to Prevent Alcohol-Impaired Crashes" U>S> Department of Transportation NHTSA, DOT HS 810 833, Sep. 2007, pp. 1-108.

Pollard, et al "Vehicle Technologies to Prevent Crashes Involving Alcohol-Impaired Drivers" The Volpe Center, Aug. 11, 2006, pp. 1-28.

Ratcliffe, "www.stltoday.com," Dec. 26, 2007, pp. 1-2. Retrieved from internet http://www.stltoday.com/stltoday/emaf.nsf/Popup retrieved on Jan. 18, 2008.

Roberston, et al. "Continuous Transdermal Alcohol Monitoring : A primer for Criminal Justice Professionals" Traffic Injury Research Foundation, Oct. 2006, pp. 1-34.

Shellem, "SCRAM Can Alert Probation Officers if Someone's Been Drinking", The Patriot-News, Nov. 25, 2007, pp. 1-3.

* cited by examiner

SYSTEMS AND METHODS FOR VARIABLE COLLISION AVOIDANCE

CROSS REFERENCE TO RELATED APPLICATION

The present application claims priority to (i.e., is a non-provisional of) U.S. patent application Ser. No. 61/266,206 entitled "Systems and Methods for Variable Collision Avoidance", and filed Dec. 3, 2009 by Buck. The entirety of the aforementioned application is incorporated herein by reference for all purposes.

BACKGROUND OF THE INVENTION

The present invention is related to monitoring movement, and in particular to systems and methods for avoiding contact between monitored entities.

Various approaches have been used to monitor the location and activity of individuals that for one reason or another require additional supervision. As an example, a tracking device may be attached to an individual and used to report the location of the individual at any given time. This information has traditionally been used by, for example, a parole officer assigned to monitor the individual to assure that the individual is staying within the parameters of their parole. Such a monitoring agency system gathers location information associated with a number of individuals being monitored and stores it to a database. This database may then be accessed by an authorized entity to monitor the activity of a given individual. Merely providing location information to a monitoring agent may not allow for effective interruption of criminal activity.

Hence, for at least the aforementioned reasons, there exists a need in the art for advanced systems and methods for monitoring entities.

BRIEF SUMMARY OF THE INVENTION

The present invention is related to monitoring movement, and in particular to systems and methods for avoiding contact between monitored entities.

Various embodiments of the present invention provide collision avoidance systems that include: a first monitoring device, a second monitoring device, and a monitoring system. The monitoring system is operable to: receive information from the first monitoring device and the second monitoring device, identify a first zone around the first monitoring device and a second zone around the second monitoring device, and identify an intersection of the first zone and the second zone.

In some instances of the aforementioned embodiments, at least one of the first zone and the second zone is variable in size. In some such instances, the first zone is variable based upon inferred intent of an entity associated with the first monitoring device. Such inferred intent may be based upon proximity of the first monitoring device to a location known to be frequented by an entity associated with the second monitoring device. In other instances of the aforementioned embodiments, the first zone is variable based upon the speed of an entity associated with the first monitoring device and/or the second zone is variable based upon the speed of an entity associated with the second monitoring device. In yet other instances of the aforementioned embodiments, the first zone is variable based upon the direction of an entity associated with the first monitoring device relative to a location of the second monitoring device.

In some instances of the aforementioned embodiments, the monitoring system is operable to communicate a warning to an entity associated with the first monitoring device upon identifying an intersection of the first zone and the second zone. In some such instances, the warning indicates a direction for the entity associated with the first monitoring device to pursue to avoid contact with an entity associated with the second monitoring device. In one or more instances of the aforementioned embodiments, the monitoring system is further operable to send an alert to a law enforcement agency.

Other embodiments of the present invention provide monitoring systems that include: a computer and a computer readable medium. The computer readable medium may be any medium accessible to a computer including, but not limited to, a hard disk drive, a random access memory, a flash memory, an optical memory, combinations of the aforementioned or the like. The computer readable medium includes instructions executable by the computer to: receive information from a first monitoring device associated with a first entity and a second monitoring device associated with a second entity; identify a first zone around the first monitoring device; identify a second zone around the second monitoring device, wherein the second zone is variable in size; and identify an intersection of the first zone and the second zone.

Yet other embodiments of the present invention provide methods for collision avoidance. Such methods include: receiving information from a first monitoring device associated with a first entity and a second monitoring device associated with a second entity; defining a first zone around the first monitoring device; defining a second zone around the second monitoring device where the second zone is variable in size; modifying the size of the second zone based upon a change in status of the second monitoring device; and identify an intersection of the first zone and the second zone.

This summary provides only a general outline of some embodiments according to the present invention. Many other objects, features, advantages and other embodiments of the present invention will become more fully apparent from the following detailed description, the appended claims and the accompanying drawings and figures.

BRIEF DESCRIPTION OF THE DRAWINGS

A further understanding of the various embodiments of the present invention may be realized by reference to the figures which are described in remaining portions of the specification. In the figures, similar reference numerals are used throughout several drawings to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

Figure 1:
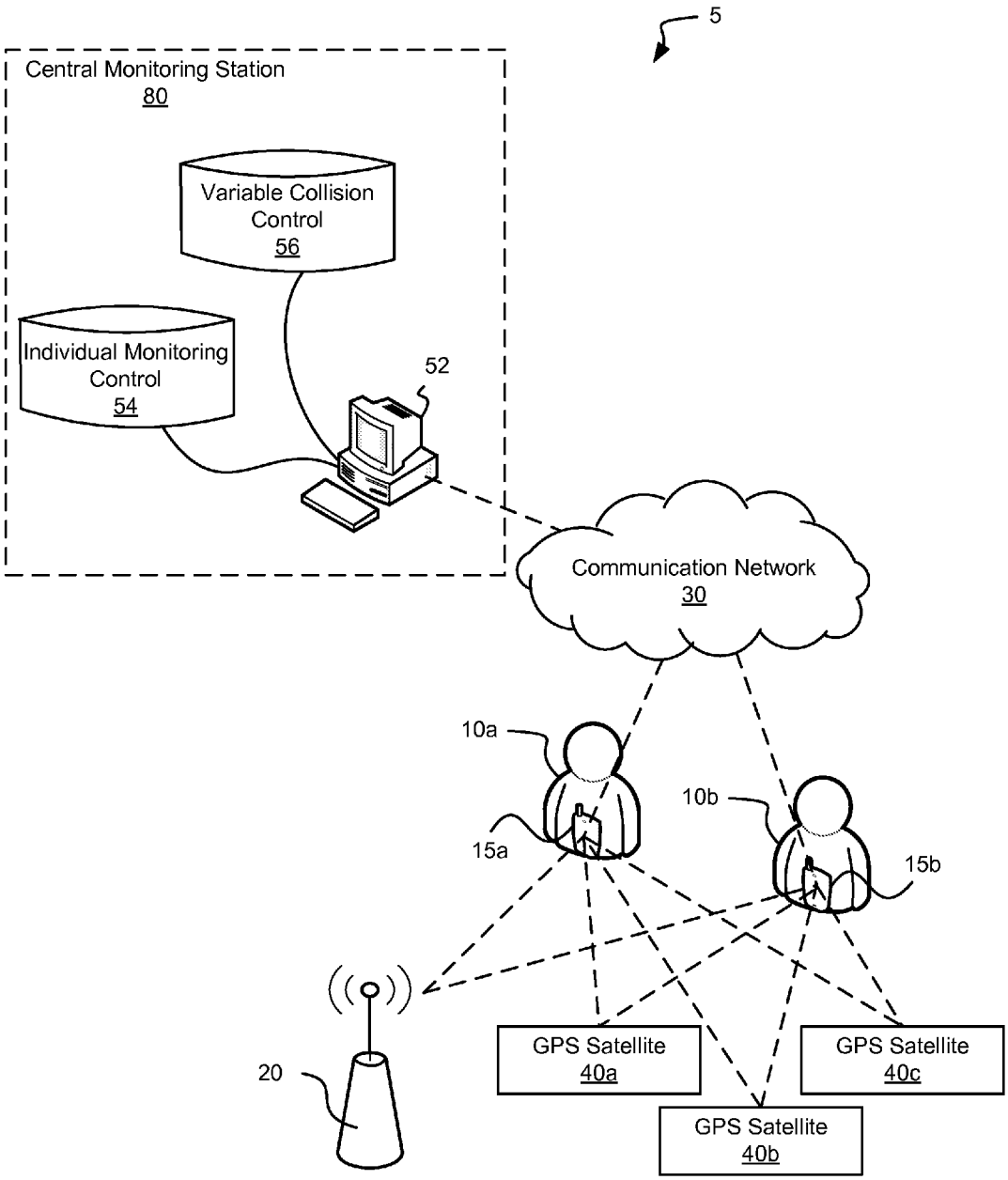
FIG. 1 depicts a monitoring system including a monitoring agency system with variable collision control in accordance with one or more embodiments of the present invention.

The present invention is related to monitoring movement, and in particular to systems and methods for avoiding contact between monitored entities.

Various approaches and systems have been developed for monitoring the location of individuals. As an example, U.S. patent application Ser. No. 12/041,746 entitled "Beacon Based Tracking Device and Methods for Using Such" and filed Mar. 4, 2008 by Buck et al. discloses a monitoring system. As another example, U.S. patent application Ser. No. 12/608,109 entitled "Systems and Methods for Adaptive Monitoring of Physical Movement" and filed Oct. 29, 2009 by Buck discloses another monitoring system. Each of the aforementioned patent applications is assigned to an entity common hereto and share a common inventor. In addition, each of the aforementioned patent applications is incorporated herein by reference for all purposes. Among other things, such monitoring systems monitor the location of a number of individuals and report that location to a central database. In some cases, the monitoring of the individuals is forced by a judicial system due to a conviction of the individual for prior criminal activity. In other cases, the monitoring is consensual.

Various embodiments of the present invention provide systems and methods for identifying a probability of contact between monitored entities. In some cases, the monitored entities are humans. In such cases, the systems and methods may further include a warning of a potential contact and continued monitoring to determine whether a warning was heeded. In some instances, the probability of contact is partially determined by applying a variable collision zone around one or more monitored entities, and identifying when the collision zone is entered by another entity or where there is an intersection or overlap of collision zones associated with respective monitored entities. As just one of many advantages, such an approach allows for reducing the possibility of a false warning of a potential collision as the collision zones are modified to reflect probabilities of an inferred intent to perform undesired acts and/or opportunity to engage in undesired acts. Based upon the disclosure provided herein, one of ordinary skill in the art will recognize a variety of other advantages that may be achieved in relation to one or more embodiments of the present invention.

In some cases, a variable zone may be implemented as multiple fixed zones. Thus, for example, three fixed zones may concentrically surround an individual with each zone indicating a different level of probability of contact. Crossing an outer zone may indicate a ten percent probability of an encounter, crossing a middle zone may indicate a forty percent probability of encounter, and crossing an interior zone may indicate an eighty percent probability of encounter. In this way, while each of the individual zones is fixed, the variable probability associated with each of the fixed zones operates to provide an overall variable zone. Thus, as used herein, the term "variable zone" may be used in its broadest sense to mean either a single zone that may vary in size, multiple fixed zones that each offer a variable probability, or a combination thereof.

Turning to FIG. 1, a monitoring system 5 is shown that includes a central monitoring station 80 employing variable collision control 56 in accordance with one or more embodiments of the present invention. Monitoring system 5 includes a number of location monitoring devices 15 that are each attached to respective individuals 10. Monitoring devices 15 are capable of receiving GPS location information from GPS satellites 40 and/or terrestrial based location reference systems 20. This location information may be time stamped and transmitted on a periodic or real time basis to a central monitoring station 80 via a communication network 30.

Central monitoring station 80 includes an individual monitoring control 54 that is responsible for monitoring the location of a number of individuals 10 that are transmitting location information to a server 52 via communication network 30. In addition, central monitoring station 80 is operable to determine a likelihood of a collision or contact between one or more individuals 10 being monitored by central monitoring station 80. Server 52 maybe any device or system known in the art that is capable of receiving information via communication network 30 and for performing operations as directed by individual monitoring control 54 and/or variable collision control 56. In some embodiments of the present invention, server 52 is a microprocessor based device. In such embodiments, variable collision control 56 may be a computer readable medium including instructions executable by a microprocessor to implement the operations related to variable collision control 56. Similarly, individual monitoring control 54 may be a computer readable medium including instructions executable by a microprocessor to implement the operations related to individual monitoring control 54.

In some embodiments of the present invention, each of monitoring devices 15 provides directional velocity information in addition to the raw location information. This directional velocity information may be derived from multiple location points determined based upon GPS satellites 40 and/or terrestrial based location reference systems 20, and may be used by variable collision control 56 of central monitoring station 80 to determine probabilities of collisions between individuals 10*a*, 10*b*. Alternatively, in other embodiments of the present invention the time stamped location information received from each of monitoring devices 15 is used by central monitoring station 80 to calculate directional velocity information that may then be used to determine probabilities of collisions between individuals 10*a*, 10*b*. In addition, variable collision control 56 of central monitoring station 80 uses location information from monitoring devices 15 along with particular geographic information to determine probabilities of collisions between individuals 10*a*, 10*b*. Based upon the disclosure provided herein, one of ordinary skill in the art will recognize other information that may be utilized to determine probabilities of collisions between individuals 10*a*, 10*b*.

Communication network 30 may be, for example, a cellular telephone network or other communication networks. Based upon the disclosure provided herein, one of ordinary skill in the art will recognize a variety of communications networks and combinations of communications networks that may be used in relation to different embodiments of the present invention to transfer information between monitoring devices 15 and central monitoring station 80.

In operation, central monitoring station 80 receives location information and/or directional velocity information from monitoring devices 15 each associated with respective individuals 10. Individual monitoring control 54 maintains the received information and compares the information against rules intended to limit movement of the respective individuals 10. The rules may be programmed or otherwise updated using any approach known in the art. The rules may be specific to a given individual 10 indicating locations that the given individual is not allowed to be. For example, in the case where a restraining order is entered disallowing contact by individual 10*a* to individual 10*b*, the a perimeter around the residence and/or work place of individual 10*b* may be indicated as areas where individual 10*a* is not allowed to enter. Where individual 10*a* violates one of these regions, individual monitoring control 54 causes central monitoring station 80 to issue a violation update to monitoring recipient (not shown) charged with monitoring individual 10*a*.

Variable collision control 56 utilizes location and/or directional velocity information to determine a potential or probability of collision between two individuals 10. For example, where there is a restraining order disallowing contact by individual 10*a* and individual 10*b*, variable collision control 56 determines whether there is a probability of contact between individual 10*a* and individual 10*b*. Where there is a probability, variable collision control 56 may cause central monitoring station 80 to issue a warning to one or both of individual 10*a* and individual 10*b* indicating the determined probability and allowing the individuals to take corrective action. In some cases, in addition to the warning may cause central monitoring station 80 issue instructions for how to proceed to reduce the determined potential for contact. The aforementioned warnings may be communicated to the respective individuals 10 from central monitoring station 80 via communication network 30. The message(s) may be received via monitoring device(s) 15 or via other communication devices associated with the respective monitored individuals 10 such as, for example, cell phones.

The probability of contact may be based on various factors that can be discerned from the location of individuals and/or the rate of movement of one of more of individuals 10. For example, a probability of contact may be reduced where one or more of individuals 10 are traveling at a high rate of speed suggesting more of an incidental passing rather than an intent to contact. As another example, a probability of contact may be heightened when a direction of travel of an individual 10 is toward a restricted or otherwise identified area. As yet another example, a probability of contact may be heightened when individuals that are expected to avoid contact are located in an area known to be frequented by one of the individuals 10 as compared with a similarly proximity in an area that is not known to be frequented by one of the individuals 10. Based upon the disclosure provided herein, one of ordinary skill in the art will recognize a variety of information that may be used in determining probability of contact.

In some embodiments of the present invention, the probability of contact is represented by a collision zone or region of concern around an individual. Where the probability of contact is increased, the size of the collision zone around the respective individual is increased. In contrast, where the probability of contact is decreased, the size of the collision zone around the respective individual is decreased. Where the collision zones around two individuals that are not to be in contact overlap, a collision or contact between the individuals is considered to be probable. By making the collision zones variable based upon location and/or directional velocity information, a likelihood that a probability of collision is worthy of concern may be modified based upon knowledge of frequented locations and/or relative speeds and directions of the monitored individuals.

Alternatively, some embodiments of the present invention may use multiple zones surrounding an individual with each zone representing a degree of concern. This may be done in place of a single modifiable zone previously discussed. Each of the zones may be individually programmed. In one case the zones may be concentric rings. In other cases, different shaped zones may be used. As the distance between individuals of interest decreases, succeeding zones will be breached. As an individual passes through each of the multiple rings a probability of contact is increased and an awareness of the monitoring authority is increased.

Figure 2:
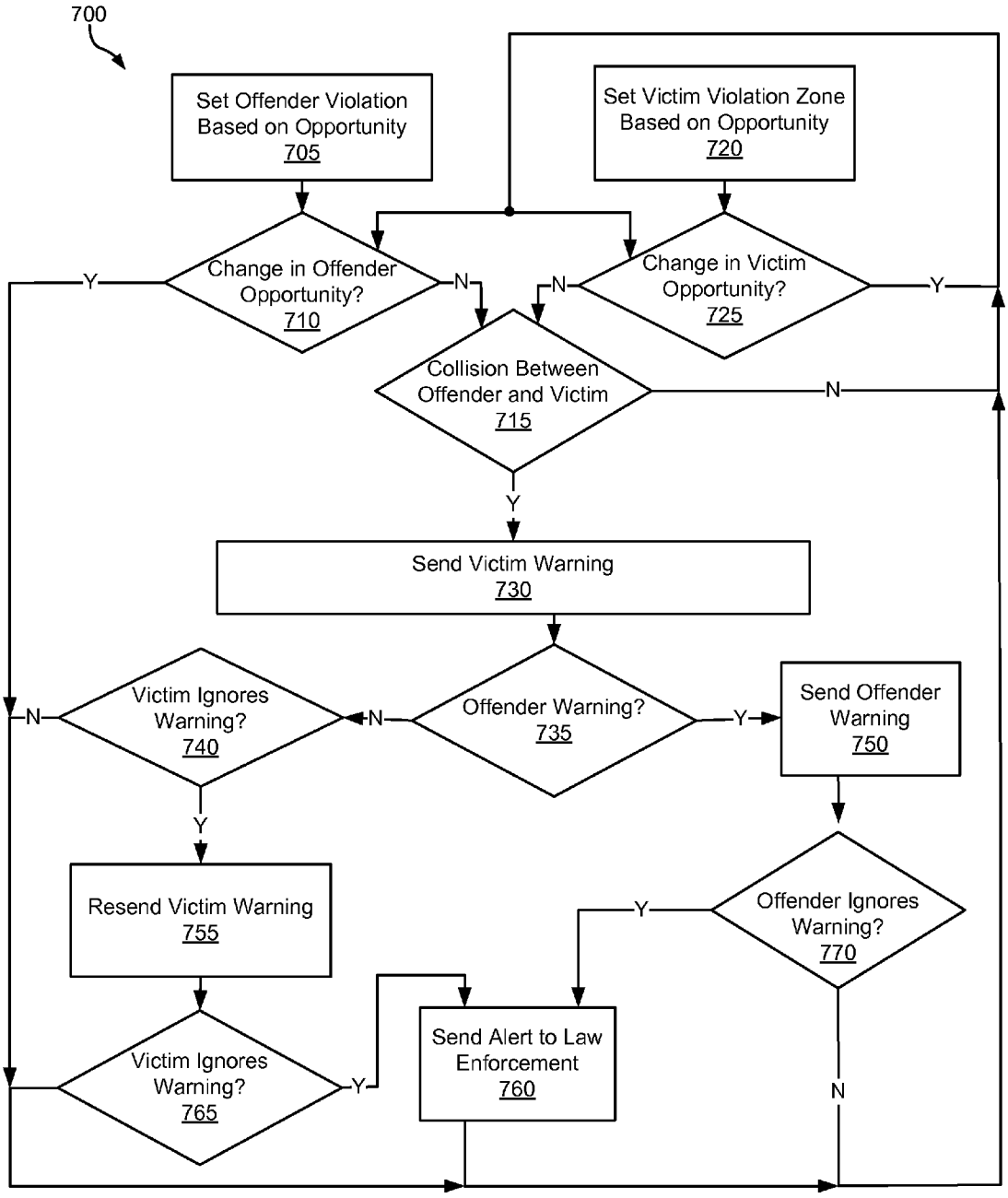
FIG. 2 is a flow diagram showing a method in accordance with some embodiments of the present invention for variable collision avoidance.

Turning to FIG. 2, a flow diagram 700 shows a method in accordance with some embodiments of the present invention for variable collision avoidance. The method of flow diagram 700 may be embodied in hardware and/or computer executable instructions implemented as part of variable collision control 56 discussed above in relation to FIG. 1. Following flow diagram 700, an offender's collision or violation zone is set based upon the opportunity to carry out an undesired act (block 705). Such an offender may be a monitored individual similar to that discussed above in relation to FIG. 1. Setting the offender's collision or violation zone may include, for example, setting a collision zone that varies depending upon the rate of speed at which the offender is traveling and/or whether the offender is moving in a direction toward the victim. For example, where the offender is moving away from the victim the collision zone may be smaller than when the offender is moving toward the victim. The collision zone may also be smaller when the offender is moving at a relatively high speed as the chance for carrying out an undesired action at a high speed may be considered less likely. Similarly, a victim's collision or violation zone is also set based upon the opportunity to be affected by an undesired act (block 720). Such a victim may be another monitored individual similar to that discussed above in relation to FIG. 1. Similar to the offender, setting the offender's collision or violation zone may include, for example, setting a collision zone that varies depending upon the rate of speed at which the victim is traveling and/or whether the offender is moving in a direction toward the victim. For example, the victim's collision zone may be increased when the offender is traveling at a higher rate of speed to allow the victim more chance to move out of the path of the offender.

It is determined whether a change in the offender's opportunity (block 710) or whether there is a change in the victim's opportunity (block 725). Where a change is detected (e.g., a change in direction or a change in speed) (blocks 710, 725), the respective collision zone(s) are changed. It is also determined whether there is an intersection between the offender's collision zone and the victim's collision zone (block 715). Where there is an intersection between the collision zones (block 715), a warning is sent to the victim allowing the victim to avoid contact with the offender (block 730). This warning may be sent, for example, via a text message or graphically with a map showing both the victim's location and the offender's location on a map display. In some cases, the message may be sent to the monitoring device (e.g., monitoring device 15) maintained in relation to the victim, or may be sent to another communication device associated with the victim such as, for example, a cell phone. Based upon the disclosure provided herein, one of ordinary skill in the art will recognize a variety of approaches that may be used to communicate the warning to the victim.

It is determined whether a warning is also to be sent to the offender (block 735). Where it appears to be an innocent interaction, the system may be configured to let the offender know that the offender is within proximity of the victim allowing the offender to move away from the victim voluntarily. The warning to the offender may be different in that it merely communicates an alternate direction to be taken to avoid contact with the victim. Alternatively, in some cases a request may have been made not to send a warning to the offender to avoid educating the offender as to the proximity of the victim.

Where an offender warning is desired (block 735), the warning is sent (block 750). This warning may be sent by any variety of communication means known in the art. It may be sent via a monitoring device (e.g., monitoring device 15) associated with the offender, or via another communication device used by the offender such as, for example, a cell phone. It is then determined whether the offender heeded the warning (block 770). This may be determined by whether the offender moved in the instructed direction or discontinued moving in the same direction as the victim. Where the offender did not heed the warning (block 770), an alert is sent to law enforcement of a possible undesired activity (block 760). Alternatively, where the offender heeded the warning (block 770), the collision is avoided and the process begins again.

Where an offender warning is not desired (block 735), it is determined whether the victim is ignoring the warning sent to them (block 740). This may be determined, for example, by whether the victim begins a path moving away from the offender, speeds up, or otherwise adjusts their behavior. Where the victim did not heed the warning (block 740), a second alert is sent to the victim updating the victim on the seriousness of the situation (block 755). It is then determined whether the victim is continuing to ignore the warning sent to them (block 765). Where the victim continues to ignore the warning (block 765), an alert is sent to law enforcement of a possible undesired act (block 760). Alternatively, where the victim heeds the warning (block 740, block 765), the collision is avoided and the process begins again.

Figure 3:
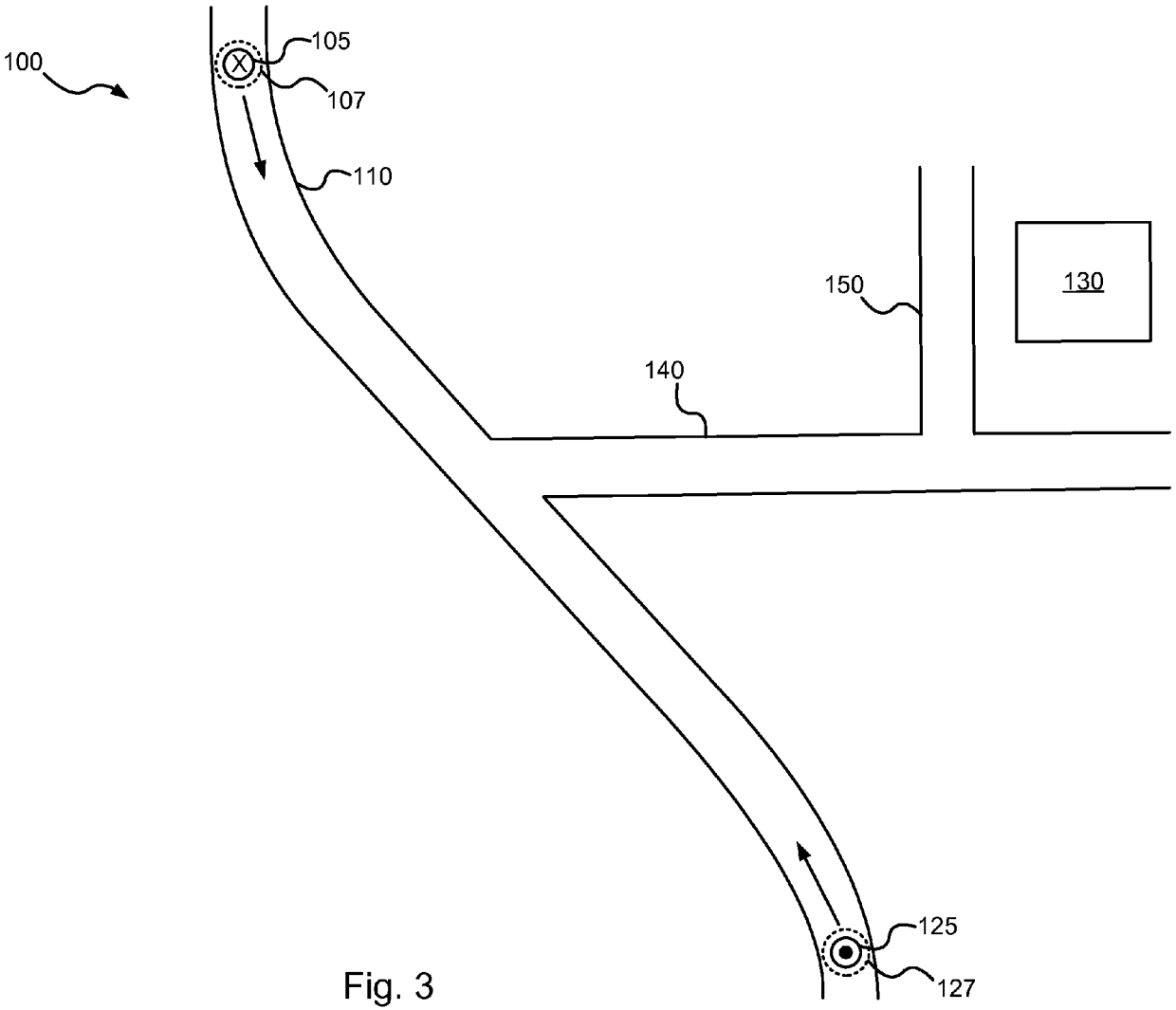
FIG. 3 shows a map including two monitored individuals moving toward each other down a road in accordance with various embodiments of the present invention.

FIGS. 3 through 8 graphically depict the process of determining a probability of contact between two entities based upon relative direction and speed of the entities. Turning to FIG. 3, a map 100 includes an offender 105 surrounded by a collision zone 107, and a victim 125 surrounded by a collision zone 127 each traveling toward each other down a road 110. In addition, a road 140 and a road 150 provide an avenue for travel to the victim's work location 130. Of note, the allowed travel speed on road 110 is much higher than the allowed travel speed on either road 140 or road 150. The size of collision zones 107, 127 is relatively small as the opportunity to engage in undesired behavior is perceived to be limited when a monitored individual is traveling at a high rate of speed.

Figure 4:
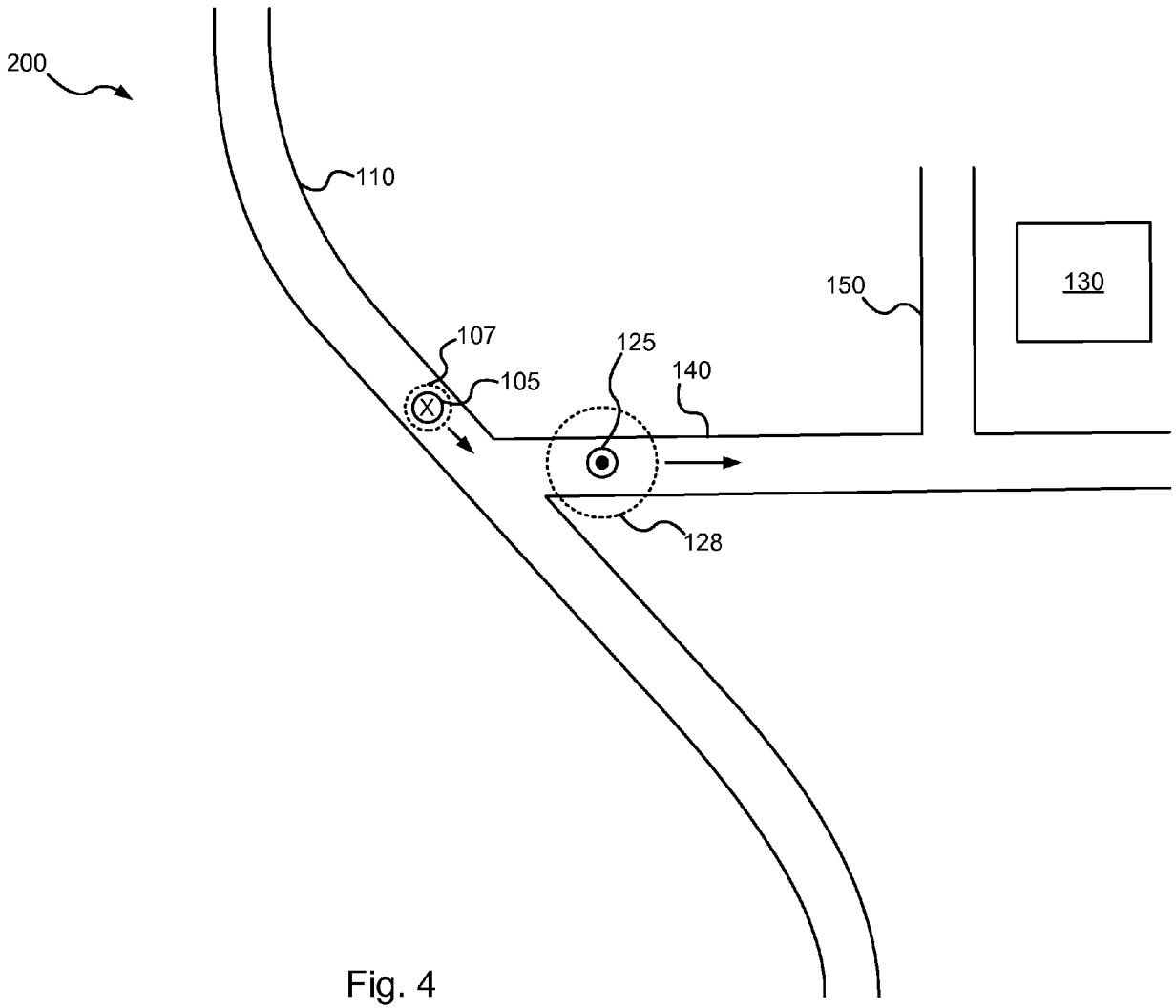
FIG. 4 is the map of FIG. 3 except that the two monitored individuals have moved closer together in accordance with one or more embodiments of the present invention.

Turning to FIG. 4, map 100 shows the monitored individuals closer to each other with victim 125 turning off onto road 140, and offender 105 continuing down road 110. Of note, a collision zone 128 around victim 125 is extended or increased when compared with the earlier collision zone 127 as the rate of travel of victim 125 decreases as victim 125 turns onto road 140. The size of collision zone 127 is relatively large as the speed of travel along road 140 provides a greater opportunity to carry out an undesired act.

Figure 5:
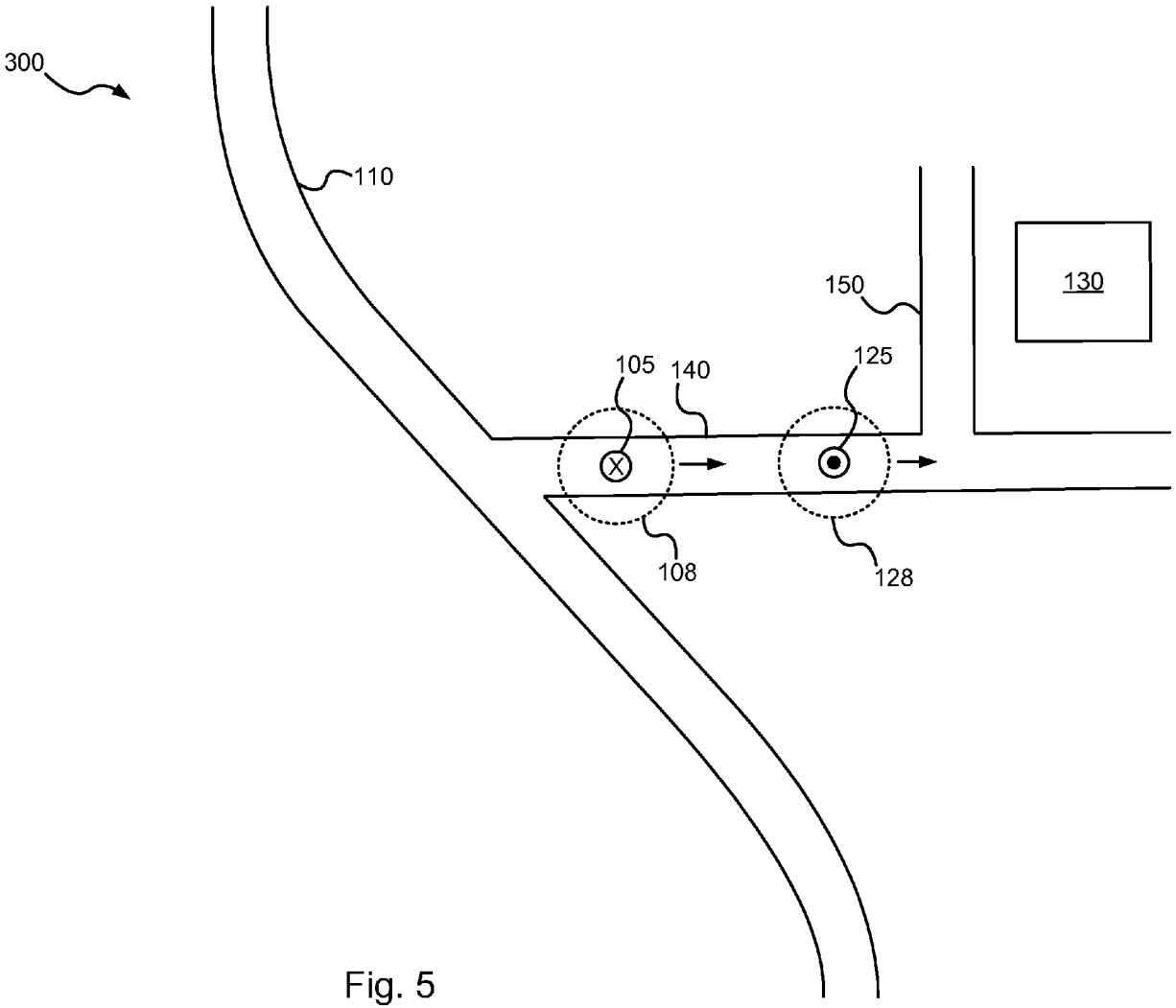
FIG. 5 is the map of FIG. 3 except that the two monitored individuals are shown moving along a new path together in accordance with particular embodiments of the present invention.

Turning to FIG. 5, map 100 shows the monitored individuals closer to each other with both victim 125 and offender 140 traveling down road 140. Of note, a collision zone 108 around offender 105 is extended when compared with the earlier collision zone 107 as the rate of travel of offender 105 decreases as offender 105 turns onto road 140. The size of collision zone 107 is relatively large as the speed of travel along road 140 provides a greater opportunity to carry out an undesired act.

Figure 6:
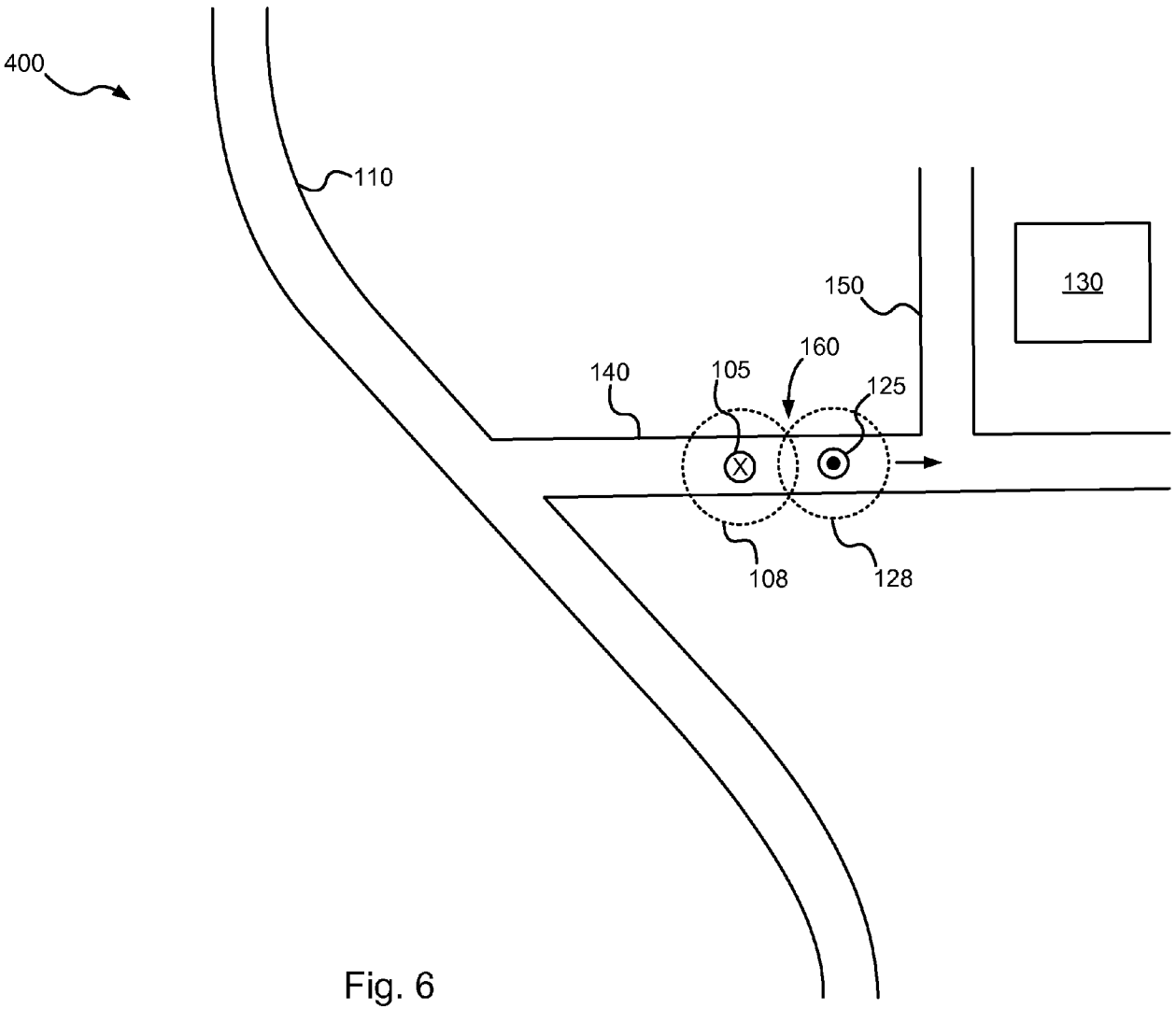
FIG. 6 is the map of FIG. 3 except that the two monitored individuals are shown in sufficient proximity that an alert is generated in accordance with various embodiments of the present invention.

Turning to FIG. 6, map 100 shows the two monitored individuals within sufficient proximity that collision zone 108 and collision zone 128 overlap at an intersection 160. This overlap indicates a probability of collision and results in issuing an alert to victim 125 and/or offender 105 indicating the proximity. Such an alert process allows one or both of offender 105 and/or victim 125 to change direction to allow for avoiding the collision. At this juncture, an alert to law enforcement is not necessarily generated. It should be noted that the size of the zones may be enlarged or reduce in size based upon the speed of the people being watched. Again, in the alternative multiple zones around each of the individuals may be used to achieve the same effect. Further, it should be noted that the zones may be oblong or some other shape. It should be noted that knowledge of a direction of travel may be used to avoid false alarms.

Figure 7:
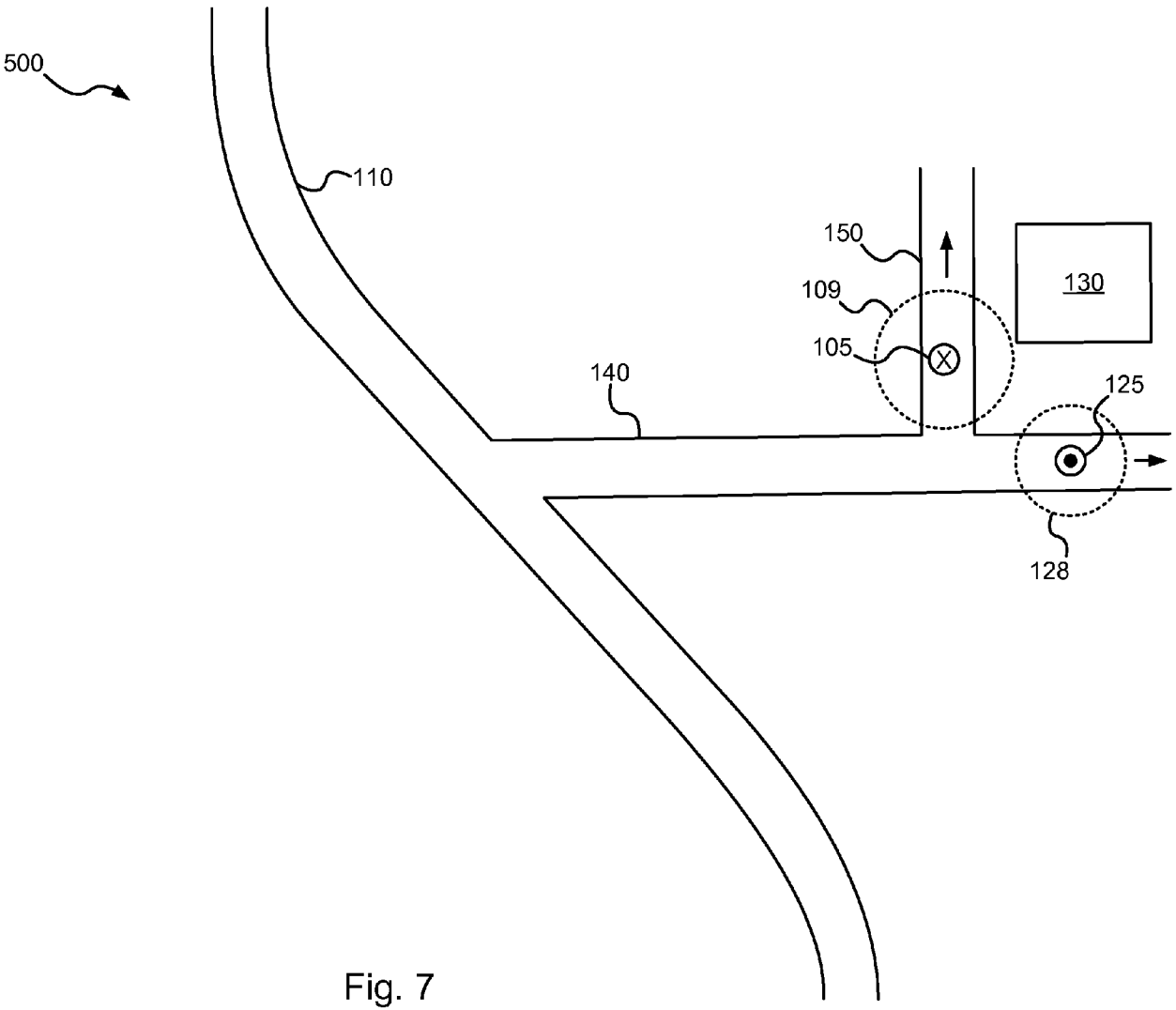
FIG. 7 is the map of FIG. 3 except that the two monitored individuals are shown in sufficient proximity that an alert is generated in accordance with various embodiments of the present invention.

Turning to FIG. 7, map 100 shows the two monitored individuals where victim 125 heeded the warning and continued down road 140 rather than turning off on road 150 toward the victim's work location 130. This evasive action cures the intersection between the collision zones which is reported to victim 125 and eliminates the earlier generation of a probability of collision. Of note, the rate of travel along road 150 is less than that along road 140. As such, a collision zone 109 around offender 105 is increased as the opportunity for undesired interaction is again increased.

Figure 8:
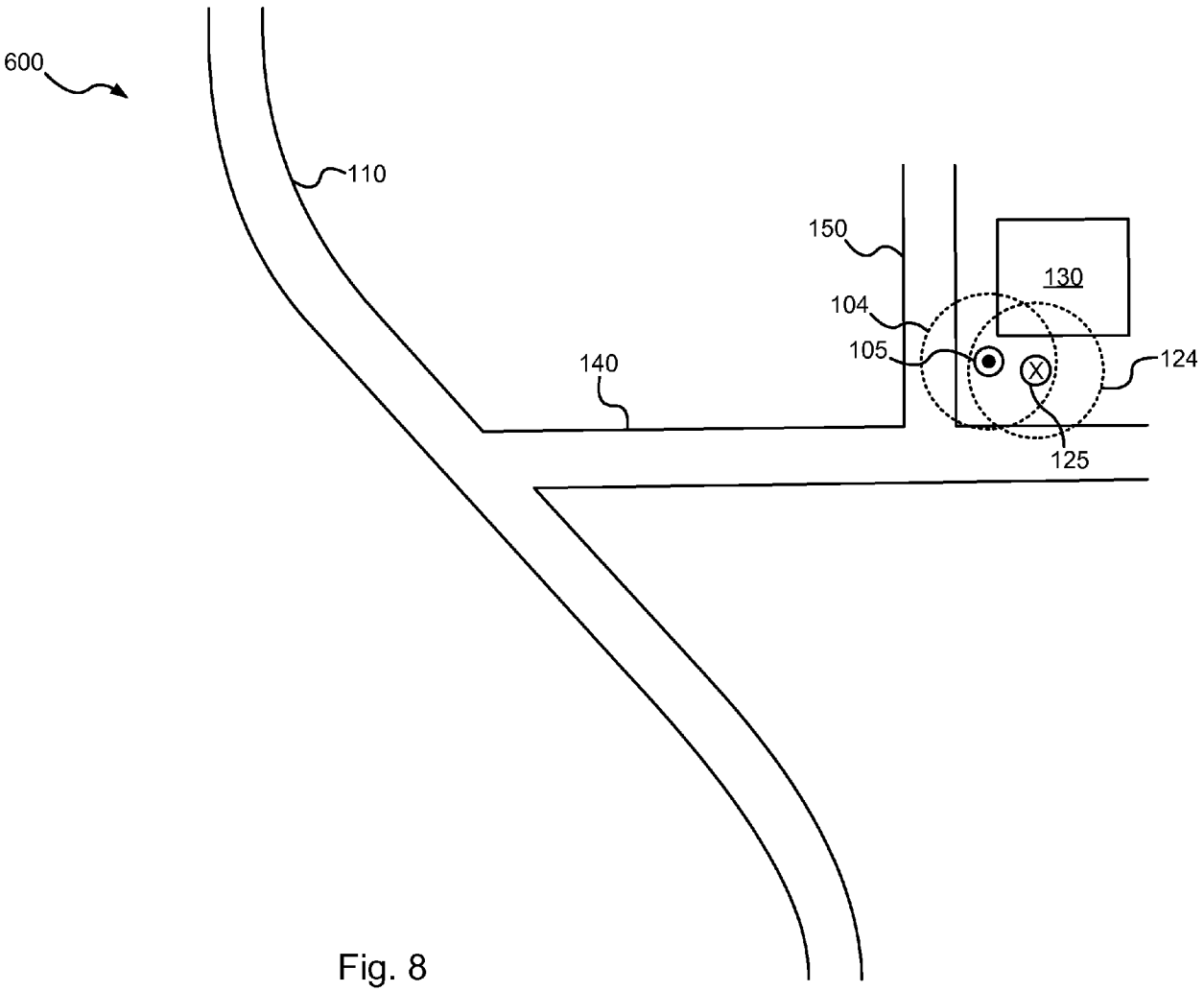
FIG. 8 is the map of FIG. 3 except that the two monitored individuals are shown in a possible incident scenario in accordance with some embodiments of the present invention.

Turning to FIG. 8, map 100 shows both victim 125 and offender 105 continuing on to the parking lot of the victim's place of work 130. In this case, the size of a collision zone 104 around offender 105 is further increased as offender 105 comes to a halt increasing the opportunity to come carry out an undesired action. Similarly, a collision zone 124 around victim 125 is further increased as victim 125 comes to a halt increasing the opportunity to carry out a undesired action. At this juncture the possibility of an undesired action or event is sufficiently increased that an alert is sent out to law enforcement.

Figure 9:
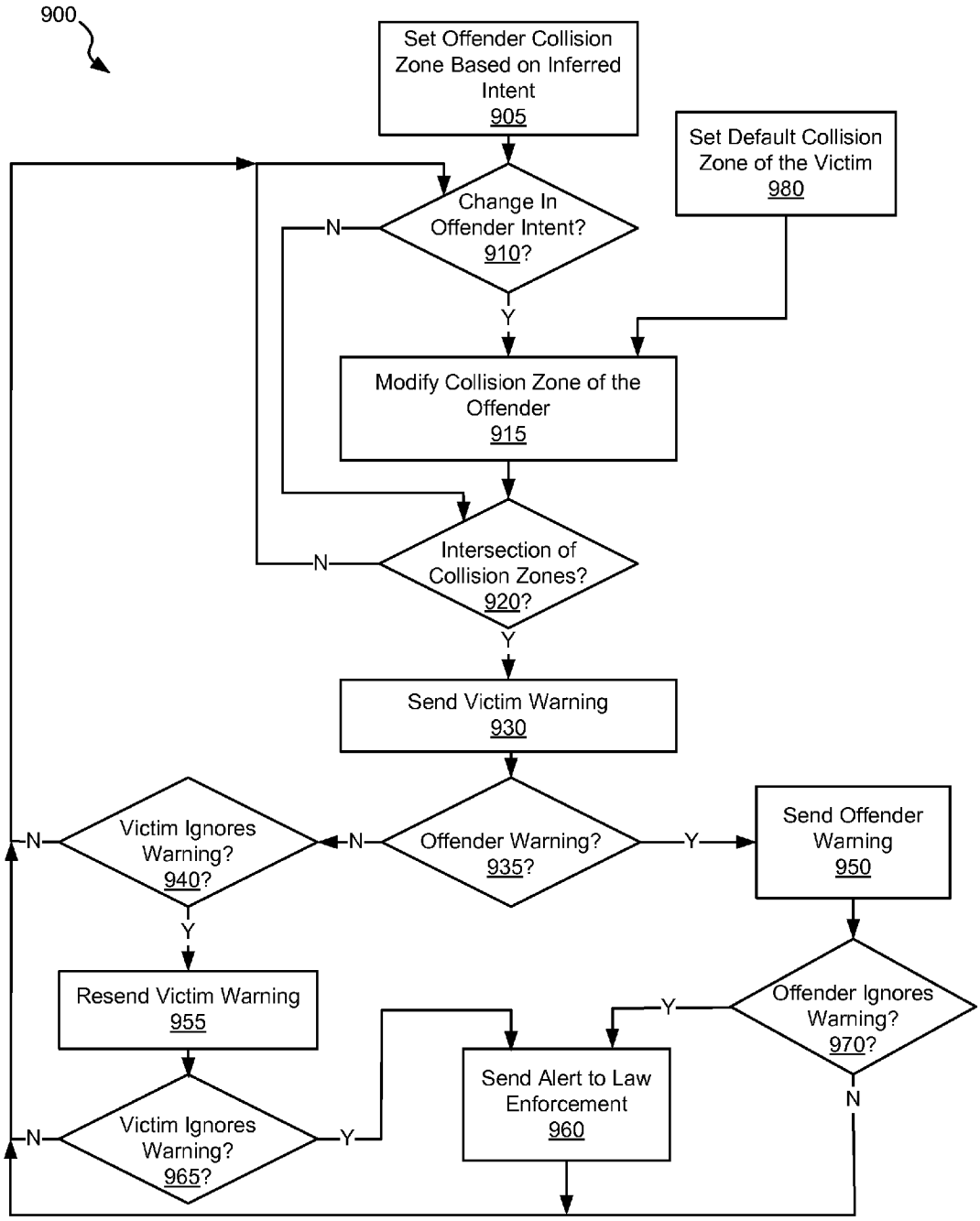
FIG. 9 is a flow diagram showing a method in accordance with some embodiments of the present invention for variable collision avoidance relying on location and proximity.

Turning to FIG. 9, a flow diagram 900 shows a method in accordance with some embodiments of the present invention for variable collision avoidance relying on location and proximity. The method of flow diagram 900 may be embodied in hardware and/or computer executable instructions implemented as part of variable collision control 56 discussed above in relation to FIG. 1. Following flow diagram 900, an offender's collision or violation zone is set based upon the offender's inferred intent to carry out an undesired act (block 905). Such an offender may be a monitored individual similar to that discussed above in relation to FIG. 1. In this case, intent may be inferred from an offender's proximity to a location known to be frequented by a victim. For example, where the offender is positioned near a location known to be frequented by a victim such as, a victim's residence, work, or commonly used shopping area, the intent of the offender to involve in undesired activity is presumed to be higher than if the offender is positioned away from such locations. A collision zone around the offender is sized relative to the inferred intent. Where the inferred intent is high, the collision zone is relatively large in comparison to the collision zone when the inferred intent is low.

In addition, a standard collision zone is defined around the victim (block 980). This collision zone, unlike the collision zone around the offender is static and is defined to give a victim enough time to move away from the offender in the event that an overlap of collision zones is detected.

It is then determined whether there is a change in the inferred intent of the offender (block 910). In this case, it is determined whether the offender has moved closer to or away from a location known to be frequented by the victim. Where there is no change in the inferred intent of the offender (block 910), it is determined whether there is an intersection of the collision zone around the offender and the collision zone around the victim (block 920). Where no intersection of the collision zones is detected (block 920), the process returns to determine whether there is a change in inferred intent (block 910).

Otherwise, where there is an intersection of the collision zones (block 920), a warning is sent to the victim allowing the victim to avoid contact with the offender (block 930). This warning may be sent, for example, via a text message or graphically with a map showing both the victim's location and the offender's location on a map display. In some cases, the message may be sent to the monitoring device (e.g., monitoring device 15) maintained in relation to the victim, or may be sent to another communication device associated with the victim such as, for example, a cell phone. Based upon the disclosure provided herein, one of ordinary skill in the art will recognize a variety of approaches that may be used to communicate the warning to the victim.

It is determined whether a warning is also to be sent to the offender (block 935). Where it appears to be an innocent interaction, it may make sense to let the offender know that they are within proximity of the victim allowing the offender to move away from the victim voluntarily. The warning to the offender may be different in that it merely communicates an alternate direction to be taken to avoid contact with the victim. In some cases, a request may have been made not to send a warning to the offender to avoid educating the offender as to the proximity of the victim.

Where an offender warning is desired (block 935), the warning is sent (block 950). This warning may be sent by any variety of communication means known in the art. It may be sent via a monitoring device (e.g., monitoring device 15) associated with the offender, or via another communication device used by the offender such as, for example, a cell phone. It is then determined whether the offender heeded the warning (block 970). This may be determined by whether the offender moved in the instructed direction or discontinued moving in the same direction as the victim. Where the offender did not heed the warning (block 970), an alert is sent to law enforcement of a possible undesired activity (block 960). Alternatively, where the offender heeded the warning (block 970), the collision is avoided and the process begins again.

Where an offender warning is not desired (block 935), it is determined whether the victim is ignoring the warning sent to them (block 940). This may be determined, for example, by whether the victim begins a path moving away from the offender, speeds up, or otherwise adjusts their behavior. Where the victim did not heed the warning (block 940), a second alert is sent to the victim updating the victim on the seriousness of the situation (block 955). It is then determined whether the victim is continuing to ignore the warning sent to them (block 965). Where the victim continues to ignore the warning (block 965), an alert is sent to law enforcement of a possible undesired act (block 960). Alternatively, where the victim heeds the warning (block 940, block 965), the collision is avoided and the process begins again.

Alternatively, where a change in the inferred intent of the offender is detected (e.g., a change in location relevant to the determination of inferred intent) (block 910), the collision zone around the offender is increased or decreased by an amount corresponding to the change in inferred intent (block 915). For example, where the offender moved closer to a location known to be frequented by the victim, the collision zone is increased in size. Alternatively, where the offender moved farther away from a location known to be frequented by the victim, the collision zone is decreased in size. It is then determined whether there is an intersection of the collision zone around the offender and the collision zone around the victim (block 920). Where a collision is detected (block 920), the processes of blocks 930, 935, 940, 950, 955, 960, 965, 970 are repeated as described above.

In conclusion, the present invention provides for novel systems, devices, and methods for avoiding contact between entities. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A collision avoidance system, the system comprising:
a first monitoring device;
a second monitoring device; and
a monitoring system operable to:
receive information from the first monitoring device and the second monitoring device;
identify at least a first zone around the first monitoring device, wherein the first zone moves in relation to the first monitoring device;
identify at least a second zone around the second monitoring device, wherein the second zone moves in relation to the second monitoring device; and
identify an intersection of the first zone and the second zone.

2. The system of claim 1, wherein at least one of the first zone and the second zone is variable in size.

3. The system of claim 2, wherein the first zone is variable based upon inferred intent of an entity associated with the first monitoring device.

4. The system of claim 3, wherein the inferred intent is based upon proximity of the first monitoring device to a location known to be frequented by an entity associated with the second monitoring device.

5. The system of claim 2, wherein the first zone is variable based upon a speed of an entity associated with the first monitoring device.

6. The system of claim 2, wherein the second zone is variable based upon a speed of an entity associated with the second monitoring device.

7. The system of claim 2, wherein the first zone is variable based upon a direction of an entity associated with the first monitoring device relative to a location of the second monitoring device.

8. The system of claim 2, wherein the monitoring system is operable to communicate a warning to an entity associated with the first monitoring device upon identifying an intersection of the first zone and the second zone.

9. The system of claim 8, wherein the warning indicates a direction for the entity associated with the first monitoring device to pursue to avoid contact with an entity associated with the second monitoring device.

10. The system of claim 1, wherein the monitoring system is further operable to send an alert to a law enforcement agency.

11. A monitoring system, the monitoring system comprising:

a computer;

a computer readable medium, wherein the computer readable medium includes instructions executable by the computer to:

receive information from a first monitoring device associated with a first entity and a second monitoring device associated with a second entity;

identify a first zone around the first monitoring device;

identify a second zone around the second monitoring device, wherein the second zone is variable in size; and identify an intersection of the first zone and the second zone.

12. The system of claim 11, wherein the instructions are further executable by the computer to vary the size of the second zone.

13. The system of claim 12, wherein the size of the second zone is varied based upon inferred intent of the second entity.

14. The system of claim 13, wherein the inferred intent is based upon proximity to a location known to be frequented by the first entity.

15. The system of claim 12, wherein the size of the second zone is varied based upon a speed of the second entity.

16. The system of claim 12, wherein the size of the second zone is varied based upon a direction of the second entity relative to a location of the first entity.

17. The system of claim 12, wherein the instructions are further executable by the computer to communicate a warning to at least one of the first entity and the second entity upon identifying an intersection of the first zone and the second zone.

18. A method for collision avoidance, the method comprising:

receiving information from a first monitoring device associated with a first entity and a second monitoring device associated with a second entity;

defining a first zone around the first monitoring device, wherein the first zone moves in relation to the first monitoring device;

defining a second zone around the second monitoring device, wherein the second zone moves in relation to the second monitoring device;

increasing a probability of interaction based at least in part on an intersection between the first zone and the second zone; and reporting the probability of interaction between a first individual associated with the first monitoring device and a second individual associated with the second monitoring device.

19. The method of claim 18, wherein reporting the probability of interaction includes one or more reporting actions selected from a group consisting of: reporting to a victim's advocate, reporting to a law enforcement person, reporting to a victim, reporting to a court person, reporting to a corrections person, reporting to a monitoring contractor, reporting to an employer, and reporting to a family member.

20. The method of claim 18, wherein the method further comprises:

defining a third zone around the second monitoring device; and further increasing the probability of interaction based at least in part on an intersection between the first zone and the third zone.

* * * * *